US005607111A

United States Patent [19]

Brundiek

[11] Patent Number: 5,607,111

[45] Date of Patent: Mar. 4, 1997

[54] METHOD AND APPARATUS FOR CRUSHING MATERIAL OF DIFFERENT GRAIN SIZE

[75] Inventor: Horst Brundiek, Kaarst, Germany

[73] Assignee: Loesche GmbH, Düsseldorf, Germany

[21] Appl. No.: 418,106

[22] Filed: Apr. 6, 1995

[30] Foreign Application Priority Data

Apr. 8, 1994 [DE] Germany ..... 44 12 197.0

[51] Int. Cl.[6] ..... B02C 15/06

[52] U.S. Cl. ..... 241/18; 241/47; 241/121

[58] Field of Search ..... 241/18, 47, 79.1, 241/121

[56] References Cited

U.S. PATENT DOCUMENTS

| | | | |
|---|---|---|---|
| 2,206,145 | 7/1940 | Wood | 241/121 X |
| 3,905,559 | 9/1975 | Brundiek | 241/59 |
| 5,127,590 | 7/1992 | Bunton | 241/119 |
| 5,340,041 | 8/1994 | Henning et al. | 241/119 |

FOREIGN PATENT DOCUMENTS

| | | | |
|---|---|---|---|
| 539584 | 4/1957 | Canada | 241/121 |
| 1152297 | 7/1956 | Germany . | |
| 189039 | 2/1957 | Germany . | |
| 3134601 | 5/1983 | Germany . | |
| 3418196 | 11/1985 | Germany | 241/121 |

*Primary Examiner*—John M. Husar
*Attorney, Agent, or Firm*—Keck, Mahin & Cate

[57] ABSTRACT

The invention relates to a method and an apparatus for crushing material of different grain sizes, particularly an air-swept mill. From the method standpoint there is a regulation of the fluid feed flow in the vicinity of a blade ring and with adjustable reinforcing cladding segments, so that grinding material particle flows are moved in a flow envelope, particularly in a hyperboloid torus. From the apparatus standpoint, stationary and adjustable reinforcing cladding segments are arranged as a function of the grinding rollers rolling on a grinding pan. Using adjusting devices, acting on connecting areas of the reinforcing cladding segments, it is possible to bring about a horizontal or radial adjustment and/or an inclination adjustment of the reinforcing cladding segments for regulating the fluid feed flow from the outside and in continuous manner during a crushing process.

22 Claims, 5 Drawing Sheets

FIG. 3
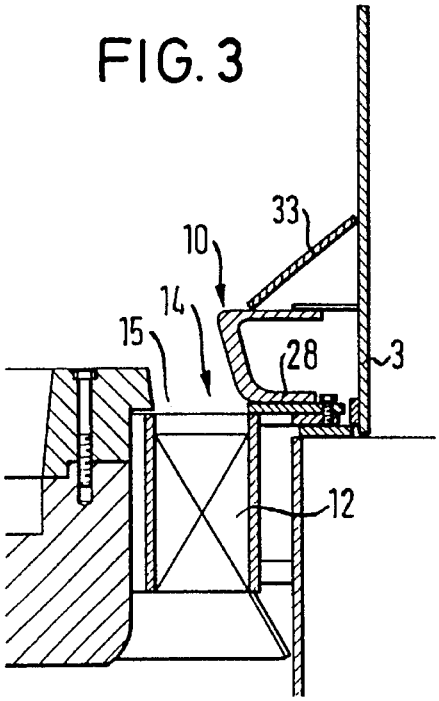
FIG. 4
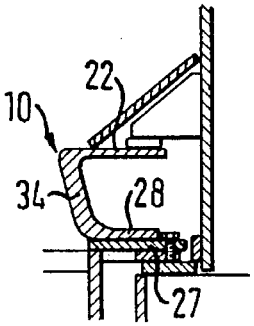
FIG. 5
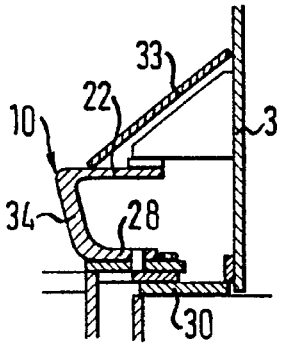
FIG. 6
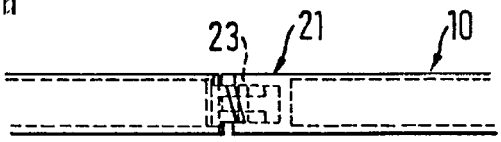
FIG. 7
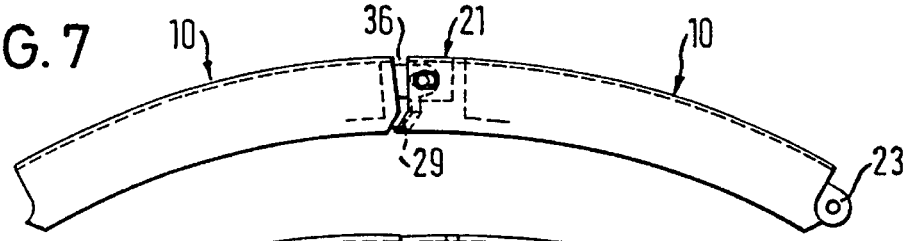
FIG. 8
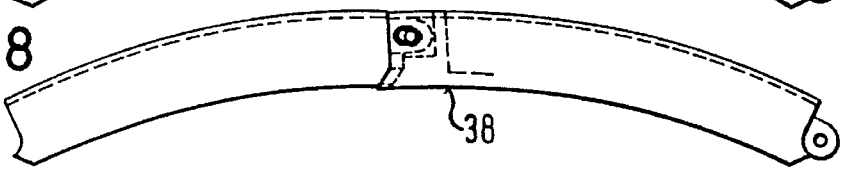
FIG. 9
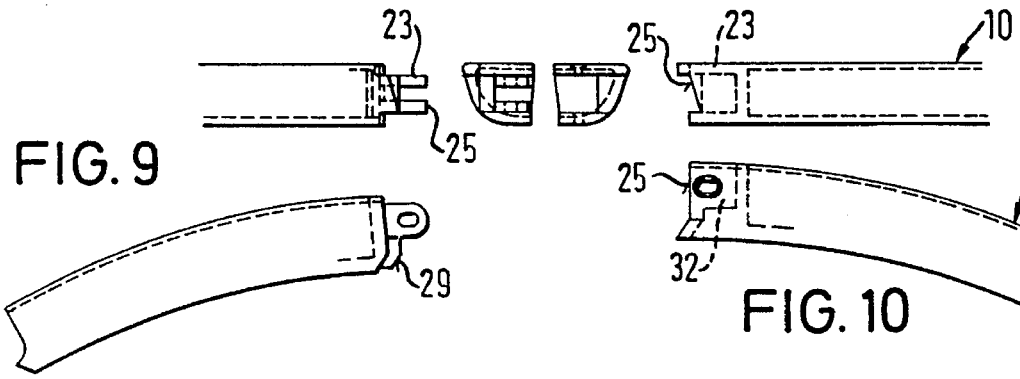
FIG. 10

METHOD AND APPARATUS FOR CRUSHING MATERIAL OF DIFFERENT GRAIN SIZE

FIELD OF THE INVENTION

The invention relates to a method for crushing material of different grain size, and to an apparatus, particularly an air-swept mill, which is suitable for performing the method.

BACKGROUND OF THE INVENTION

An air-swept mill as a crushing or comminuting device is known from DE-AS 1152297. In this air-swept mill an annular space with a blade ring is bounded by a casing wall with a reinforcing cladding as a protection against wear and a grinding surface or track with a weir. The outlet cross-section of the flow channels or ducts and the radial width of the annular space are constant and predetermined by the fixed, annular reinforcing cladding and the stationary weir. A hydraulic influencing of the feed flow is to be made possible by interchangeable blades with a clearly defined surface curvature.

Another known air-swept mill in the form of a flexible roller mill is known from German patent 189,039 and has an annular space, a weir on the grinding ring and a reinforcing cladding-like baffle wall. In order to concentrate the grinding material and fluid on the gaps between the grinding rollers, guide blades are fixed close to the centre of the grinding pan and to the casing wall. A cover ring and the baffle wall on the casing wall cover an annular space up to opening areas, which are radially adjacent to the grinding rollers. The grinding material fluid flow is deflected into the interior of the grinding chamber and below the grinding rollers. As a result of the high flow rate and the deflections turbulence occurs in the overall flow, which in the same way as inhomogeneities of the grinding bed has a disadvantageous influence on the energy balance and the effectiveness of the method and apparatus.

DE 31 34 601 C2 described an air-swept mill, in which the fluid flow is guided with the aid of feed elements to the points at which the ground material occurs. The feed elements have horizontal legs of varying length and are in each case positioned between two blades of the blade ring.

DE-OS 23 09 900 discloses an air-swept mill, whose reinforcing cladding comprises segments which can be placed on one another. Each segment is detachably fixed with two screw elements and has two upper and lower, in each case differently inclined trapezoidal surfaces as wearing surfaces. By a 180° turn about the longitudinal axis or the vertical axis an unworn surface and edge can be exposed to the feed flow. Turning about the longitudinal axis simultaneously brings about a modified, e.g. sharper deflection of the feed flow and the grinding material particles hurled into the annular space. However, the turning is time-consuming and leads to down-times, giving rise to an increase in operating costs. If only individual reinforcing cladding segments are turned for a local sharper deflection of the feed flow and are in this way adjusted, turbulence of the fluid particle flows can lead to pressure fluctuations in the grinding—classifying chamber and to inhomogeneities in the vicinity of the grinding bed, which impair the grinding capacity.

The known methods and apparatuses provide for an influencing of the grinding process with the aid of a fluid flow, which is deflected with a corresponding speed in a predetermined direction, particularly in the direction of or between the grinding rollers. For deflection purposes use is made of static means, which can only be modified after interrupting the grinding process and by dismantling or reconstruction.

The complex processes in the air-swept mill, the fact that the different parameters are dependent on one another, the influence on the grinding bed and the particle size distribution are only inadequately taken into account, so that the grinding capacity, energy consumption, fine-grain fraction, etc., cannot achieve optimum values.

SUMMARY OF THE INVENTION

The object of the invention is to provide an efficient crushing method and an efficient apparatus for crushing material of different grain size, which permit a particularly effective fluid dynamics with respect to the optimum grinding bed formation, a high throughput and a low energy consumption.

From the method standpoint, this object is achieved in a method, in which the material is supplied to a rotary, horizontal grinding surface of a grinding—classifying chamber and crushed to grinding material particles, in which the grinding material particles are supplied to a classifying process with the aid of a fluid feed flow, the fine material particles are discharged and at least part of the oversize material occurring as coarse material particles is returned to the grinding surface, the fluid feed flow being supplied by means of an annular space with a blade ring between the grinding surface and a casing wall with adjustable reinforcing cladding segments, wherein the grinding material particles thrown off over the edge of the grinding surface are exposed to a helical pattern of the feed flow, from the thrown off grinding material particles a flow envelope is formed in a helical upward movement and in which the grinding material particle flows are moved and the spatial arrangement, structure and/or the radial and vertical extension of the flow envelope are adjusted with a regulatable fluid feed flow.

According to the invention the object is achieved from the apparatus standpoint by an apparatus for crushing material, particularly by an air-swept mill, which has an annular space with a blade ring for a fluid feed flow between a rotary grinding pan and a casing wall with adjustable reinforcing cladding segments, wherein the adjustable reinforcing cladding segments are connected by means of connecting areas, on at least one connecting area engages an externally operable adjusting device and the reinforcing cladding segments are displaced at least in the radial direction and/or their inclination is adjusted.

Appropriate and advantageous developments appear in the sub-claims and the specific description relative to the drawings.

A fundamental idea of the invention is that with the aid of a device, particularly for reinforcing cladding segments, adjustably arranged on the casing wall of an air-swept mill, the fluid feed flow can be regulated and it is possible to obtain a dynamic and almost delay-free setting of a new equilibrium of the fluid feed flow in the grinding—classifying chamber of an air-swept mill with the aid of a flow envelope formed in planned manner.

The flow envelope surrounds the overflow and is preferably constructed as a hyperboloid torus with a clearly defined flow envelope curve. In this context the flow envelope curve is understood to be the outer boundary of the flow envelope close to the casing wall, particularly of a hyperboloid torus, considered in vertical axial section.

For forming a flow envelope according to the invention the grinding material particles thrown off over the edge of a grinding surface are exposed to a helical flow, preferably with ejector action at the outlet surface of the flow channels. As a result of the classifying action, in a helical upward movement a flow envelope is essentially formed from outer oversize material or marginal zone oversize material.

An essential advantage of the invention is that the flow envelope or flow envelope curves of the hyperboloid torus can be adjusted with the aid of an inclination-adjustable and/or horizontally displaceable reinforcing cladding segments during grinding.

The regulation of the fluid feed flow, which in particular takes place through a modification of the projection surface, accompanied by simultaneously influencing the flow inclination in the direction of the mill centre in the vicinity of an annular space between the grinding table and the casing wall, is used according to the invention for a clearly defined formation or construction of the flow envelope. The term projection surface is hereby understood to mean the free flow cross-section above the blade ring, whilst taking account of the position of the reinforcing cladding segments.

It is advantageous that the projection surface of the annular chamber can also be modified partially, particularly as a function of the number and nature of the rollers. Preferably the reinforcing cladding segments are arranged in horizontally adjustable manner, so that as a function of the parameters and the desired crushing result one or more reinforcing cladding segments are adjusted and consequently the flow envelope of the fluid flow can be modified. Apart from a horizontal adjustment of the reinforcing cladding segment or segments, cladding segments can be arranged in pivotable or inclination-adjustable manner about a horizontal longitudinal axis. Additionally or alternatively the reinforcing cladding segments can be provided with inclination angles continuously varying over their circumferential extension.

In conjunction with a clearly defined fluid feed flow on the guide blade ring and which is essentially determined by the speed of the fluid and a setting angle of the blades with respect to a horizontal, it is possible to set in a continuous manner from the outside and without delay using adjustable reinforcing cladding segments, a fluid feed flow within a flow envelope which is in accordance with requirements, so that the flow gradient within the air-swept mill can be influenced in planned manner.

As a function of the setting angle of the tangentially arranged blades of the blade ring an adjustment of the reinforcing cladding segments leads to a reduction of the projection surface of the annular space and therefore the outlet opening of the feed flow. Simultaneously a direction change is obtained in the sense of a modified deflection of the fluid feed flow.

It is therefore possible to modify the flow conditions during a grinding process without any significant secondary effects, turbulence, etc., in an almost "indirect" manner by means of the hyperboloid torus or the flow envelope.

In a particularly efficient manner a limited local influencing of the flow envelope can be achieved in that only one or two adjacent reinforcing cladding segments are adjusted.

Particularly with a view to a trouble free, efficient crushing and classifying process, it is appropriate to regulate the fluid feed flow in such a way that no highly ventilated grinding bed is formed upstream of a grinding roller. It is particularly advantageous that an optimum grinding bed formation can be obtained by an adjustment of the reinforcing cladding segments in such a way that the grinding rollers as disturbance variables in the system exercise a smaller influence or no disturbing influence on the fluid dynamics.

With the aid of an adjusting device at least one reinforcing cladding segment can be displaced or inclination-adjusted in the direction of the longitudinal axis of the air-swept mill, so that from a partially narrower, annular space passes a smaller, but directionally influenced fluid flow. The hyperboloid torus is then provided with an arcuate indentation on the circumference in the manner of a necking-down. Preferably in the case of a two-roller mill, two facing adjusting devices are used for adjusting the adjacent cladding segments.

It is important that a regulation of the feed flow in principle acts via the hyperboloid torus on the overall flow, which leads to a substantially homogeneous grinding bed and to an influenceable flow gradient in the grinding—classifying chamber.

As a homogeneous grinding bed can lead to an improvement in the efficiency of an air-swept mill, appropriately an adjusting device is in each case positioned upstream of each grinding roller, considered in the rolling direction.

An apparatus for crushing material and which is in particular suitable for performing the method according to the invention, e.g. an air-swept mill, is equipped according to the invention with at least one adjusting device and preferably with a number of adjusting devices corresponding to the number of grinding rollers and which can be operated from the outside and in particular during a crushing process. In each case these adjusting devices act on connecting areas, which are formed by at least two reinforcing cladding segments. The connecting areas consist of connecting elements, which can be detachably interconnected. In an appropriate and particularly cost-effective construction the reinforcing cladding segments constructed as circular ring sectors are interconnected on their longitudinal side end faces.

For a horizontal or radial displacement in the direction of the mill axis, it is appropriate to use joints as connections, which permit a one-sided or reciprocal, linear movement. It is e.g. possible to use an axial or fork joint, in which the fixing flanges are connected to a cylindrical bolt.

Fundamentally the reinforcing cladding segments can also be mounted in pivotable or inclination-adjustable manner in a horizontal longitudinal axis.

According to a further development several and in particular two reinforcing cladding segments can be interconnected by means of levers or adaptors and jointly operated. It is also possible to use ball joints or wedge-elements for adjusting the inclination.

The arrangement and number of the adjusting devices is fundamentally dependent on the number and arrangement of the grinding rollers used and optionally the precompression rollers. Preferably, downstream of each grinding roller is provided one fixed and two movable reinforcing cladding segments, but at least two movable segments. All the segments associated with the grinding rollers together form an annular reinforcing cladding.

According to an advantageous embodiment one adjusting element is constructed in bolt-like manner. The adjusting element has a bolt shank, which is guided in the vicinity of the casing wall in sleeve-like manner or via a sliding block guide. Method and economic advantages exist, because the adjusting element can be operated continuously and from the outside. A fixing to the connecting areas takes place by means of recesses with bolts.

A crushing apparatus with two grinding rollers has, advantageously, two adjusting devices in each case displaced by 180°. The segments are provided with bevels in the vicinity of the frontally positioned connecting elements, in order to permit a radial inward displacement or pivoting. In order to obtain an optimum fluid flow deflection, recesses can be provided on overlapping end regions.

The reinforcing cladding segments representing circular ring sectors and optionally having an inclination angle changing along the arc in a continuous manner, are so arranged for obtaining an adjusting path or spacing that a horizontal displacement and/or inclination adjustment or also angular displacement of two adjacent reinforcing cladding segments is ensured with a virtually sealed reinforcing cladding ring.

An unhindered adjustment of the reinforcing cladding segments is achieved by a sawtooth-like displaced arrangement of the segments.

For a horizontal displacement it is appropriate to have reinforcing cladding segments with a lower sliding surface, which is substantially horizontal and a bearing surface located on the casing wall and roughly level with the exit face of the blade ring.

In order to optionally permit a feed flow regulation by a vertically adjustable reinforcing cladding segment, an intermediate ring segment can be located between the bearing surface and the sliding surface. Parallel to the lower sliding surface is provided an upper cover surface, on which is placed a cover element. The latter prevents the collection of grinding material particles in a dead area.

A connecting surface between the lower sliding surface and the upper cover surface forms a guide surface exposed to wear and which for this reason is almost twice as thick as the sliding and cover surface. In order to deflect towards the grinding surface or track the feed flow with the grinding material particles and in particular the coarse material particles thrown off over the edge, the guide surface is in the form of an inclined surface and directed radially inwards towards the grinding chamber axis. The inclined surface can alternatively be constructed with a constant angle for forming a circular surface or with a continuously varying inclination angle.

In a particularly simple and effective adjustment device an adjusting element, which has a bolt shank led out of the mill casing and a guide head for receiving a connecting bolt, engages in a connecting area. Consequently an adjustment brings about a positional change of the two adjacent reinforcing cladding segments.

As a function of the number of grinding rollers, it can be appropriate to connect fixed reinforcing cladding segments in alternating manner with radially displaceable reinforcing cladding segments. Such an arrangement can also be appropriate for inclination-adjustable reinforcing cladding segments. Inclination-adjustable or pivotable segments are constructed similar to the horizontally displaceable segments. Appropriately the base is shortened and constructed as a horizontal pivoting axis for an inclination adjustment directed towards the mill axis.

By means of a method and apparatus according to the invention it is possible in advantageous manner to regulate and optimize a crushing process, in which at least partially marginal zone oversize materials are discharged, because a fictional impact point of such marginal zone oversize material of the hyperboloid torus is fixable in defined manner on the casing wall. In this way the flow resistance is particularly low and a maximum throughput can be obtained.

BRIEF DESCRIPTION OF THE DRAWINGS

The invention is described in greater detail hereinafter relative to the attached drawings, wherein show:

FIGS. 3, 4 & 5 A larger-scale view of an annular space with a reinforcing cladding segment according to FIG. 1 and two horizontally adjustable arrangements.

FIG. 6 A vertical section through a connecting area between two reinforcing cladding segments.

FIG. 7 A plan view of the connecting area in FIG. 6.

FIG. 8 A plan view of a connecting area between two reinforcing cladding segments, which are displaced towards the grinding chamber axis (internal adjustment).

FIG. 9 A reinforcing cladding segment with frontally positioned connecting elements in a vertical section and in plan view.

FIG. 10 An adjacent reinforcing cladding segment with complementary-constructed connecting area with the reception of an adjusting element.

DESCRIPTION OF A PREFERRED EMBODIMENT

Figure 1:
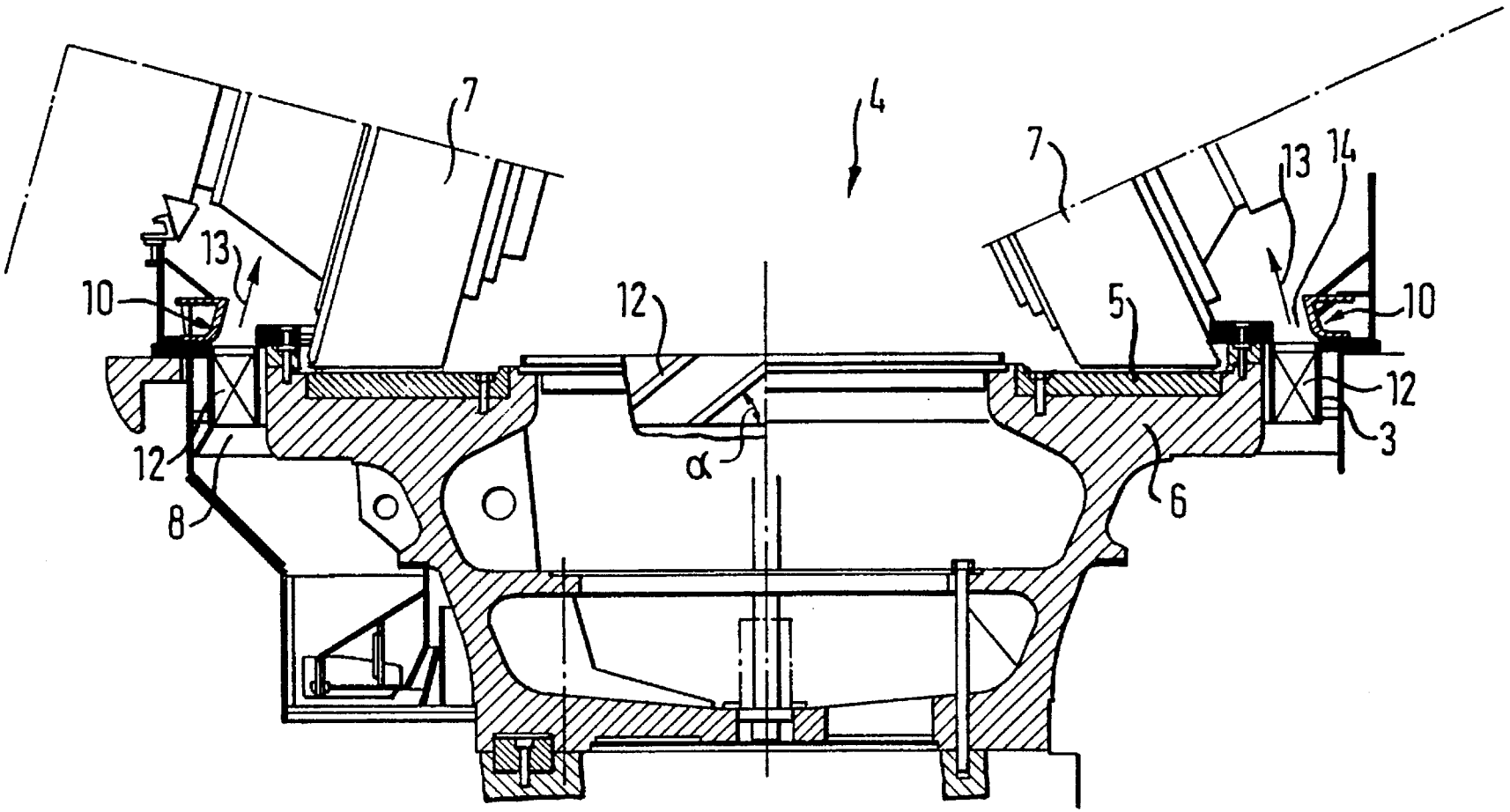
FIG. 1 A vertical section through an apparatus according to the invention as a detail in the vicinity of a grinding pan with a blade ring.

FIG. 1 shows in detail form an air-swept mill 4 in the vicinity of a grinding pan 6 as an apparatus for crushing material. On a grinding track or surface 5 roll in frictionally engaging manner grinding rollers 7, or the latter are separately driven. The material to be crushed and having different grain sizes is supplied roughly centrally to the grinding pan 6. Between the grinding pan 6 and a casing wall is formed an annular chamber or space 8, in which is located a blade ring 12. The blades of the blade ring 12 are arranged tangentially and in a setting angle $\alpha$ (angle to the horizontal) and form an annular gas guidance device 14, whose flow channels 15 give an ejector action to a fluid feed flow 13.

Above the blade ring 12 is placed a reinforcing cladding formed from reinforcing cladding segments 10 (cf. also FIGS. 3 to 5 and 13). The reinforcing cladding segments 10 have a lower, horizontal sliding surface 28, an upper cover surface 22 parallel to the sliding surface and an inclined guidance surface 34 directed towards the annular space 8 and whose inclination and/or pivoting position permits in conjunction with the setting angle $\alpha$ of the blades of the blade ring 12 a clearly defined fluid feed flow deflection and regulation.

FIGS. 3, 4 and 5 show the positioning of a reinforcing cladding segment 10 in the vicinity of the blade ring 12. It is clear that a horizontal displacement of the reinforcing cladding segment 10 leads to a change in the vicinity of the gas guidance device 14 with respect to the direction, volume and speed of the fluid particle flow.

Figure 2:
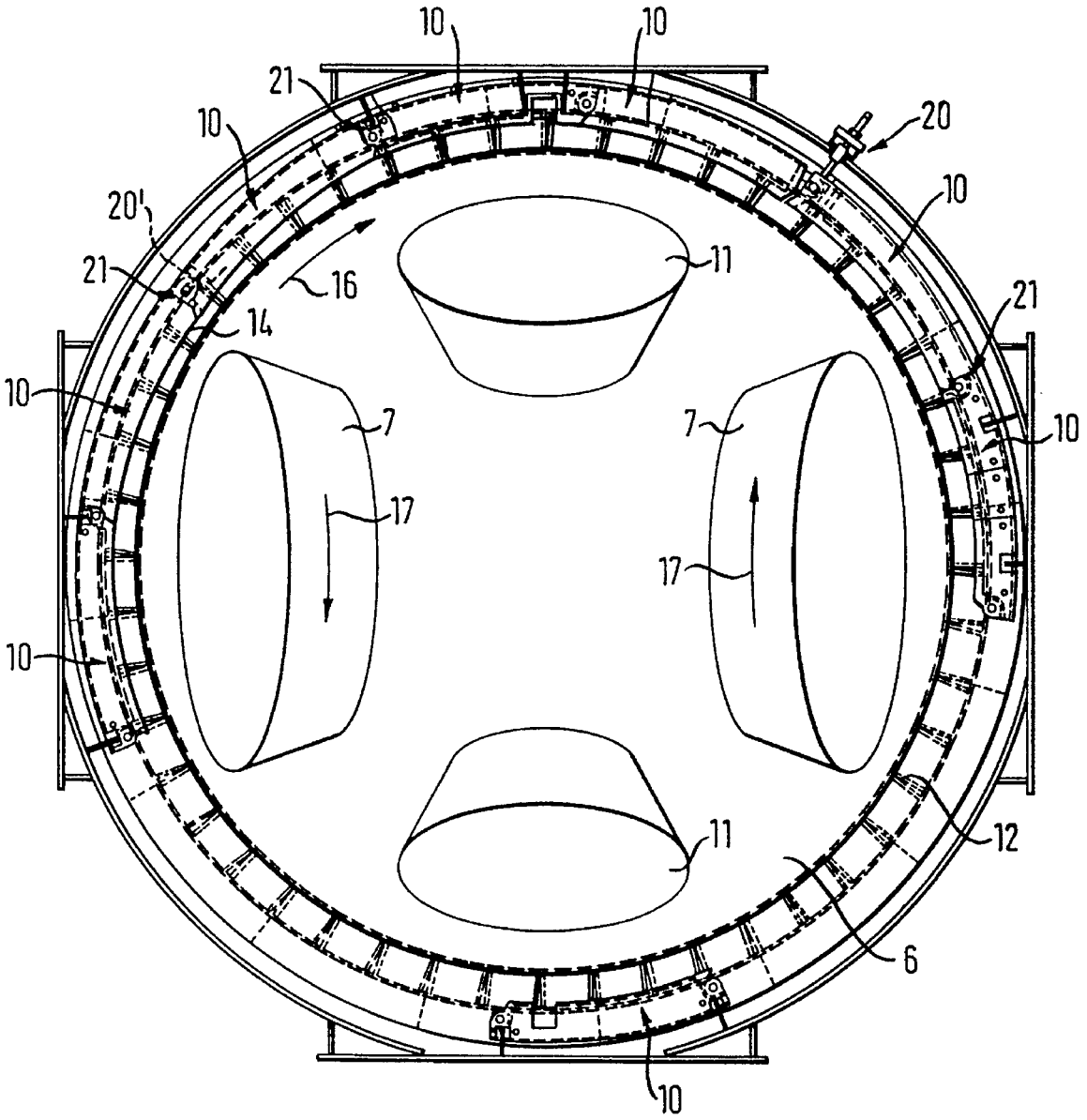
FIG. 2 A horizontal section through an apparatus according to the invention having several reinforcing cladding segments and diagrammatically represented grinding and precompression rollers.

FIG. 2 shows in a plan view a grinding pan 6 with two grinding rollers 7 and two smaller precompression rollers 11 of the blade ring 12, as well as eight of the in all twelve necessary reinforcing cladding segments 10. The same reference numerals are used for identical features. The reinforcing cladding segments 10 are interconnected by means of connecting areas 21 on their longitudinal-side end faces 25. The rotation direction of the grinding pan is indicated by an arrow 16 and the rolling direction of the grinding roller 7 by arrows 17. For ease of vision, an adjusting device 20 is e.g. positioned between a grinding roller 7 and a precompression roller 11.

According to the method of the invention, an adjustment of the reinforcing cladding segments at 20 takes place in an area which, in the rotation direction of the grinding pan 6 (arrow 16) is behind a grinding roller 7. However, the adjustment takes place at the connecting area 20' with a not shown adjusting device 20 in the form of a horizontal displacement of the reinforcing cladding segments. The projection surface of the annular space 8, which is understood to mean the free flow cross-section above the blade ring 12 and whilst taking account of the position of the reinforcing cladding segments 10, is much smaller in this area, which is located behind a grinding roller 7, than in the remaining area.

In the case of the represented grinding pan 6 with two grinding rollers 7 it is sufficient to have two adjusting devices 20 which, considered in the rotation direction of the grinding pan 6 (arrow 16), are to be positioned behind the grinding roller 7. The reinforcing cladding segments 10 participating in an adjustment can be fixed in the manner described relative to FIGS. 6 to 10, 13 and 14.

FIGS. 3 to 5 show a possible horizontal displacement of the reinforcing cladding segments 10. The sliding surface 28 is fixed by means of at least one intermediate ring segment 27 to the casing wall 3. Above the reinforcing cladding segments 10 are provided, inclined bearing cover elements 33, which are flexibly fixed and guide radially inwards to the fluid feed flow grinding material particles close to the casing wall 3.

FIGS. 6 to 10 show an appropriate construction of a connecting area 21 with connecting elements 23, which are formed at the end faces 25 of the reinforcing cladding segments 10. In the connecting area 21 a connecting bolt is inserted in circular ring-shaped bores and in an elongated hole which, if an adjusting device 20 acts on said connecting area 21, also receive a guide head 40 of an adjusting element 35 (cf. FIGS. 13 and 14). The end faces 25 of the connecting areas 21, which are provided with virtually complementary bevels 29 and recesses 32, can be gathered from FIGS. 9 and 10.

A horizontal displacement and the action of a gap spacing 36 of a connecting area 21 are shown in FIGS. 7 and 8. As a result of the tooth-like bevels 29, directed towards the mill axis, on the end faces 25 of the reinforcing cladding segments 10 and by a gap spacing 36, account is taken of a circumferential reduction associated with an adjustment in the direction of the mill axis. The path of an inner circular arc 38 of the reinforcing cladding segments 10 has in the connecting area 21 in the case of a radially inward adjustment, a substantially continuous "constriction" of the arc 38, which in the grinding process leads to a change of the fluid feed flow, particularly in the vicinity of the flow envelope of the fluid feed flow.

Figure 11C:
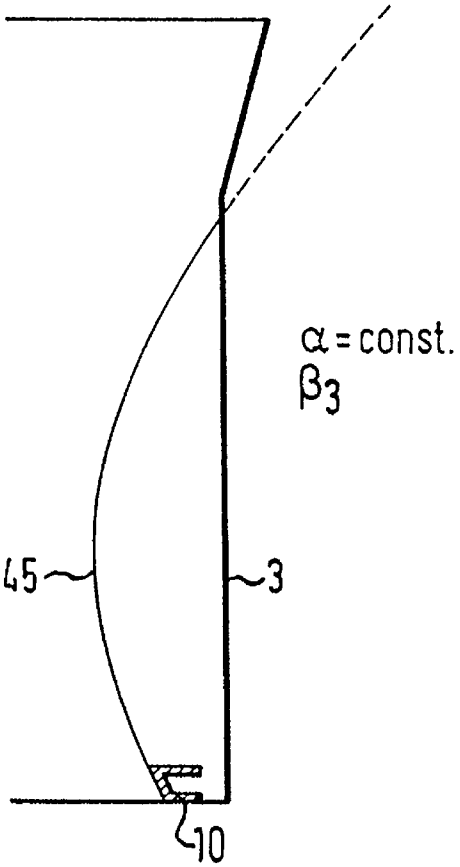
FIG. 11 A flow envelope as a function of the setting angle $\alpha$ and cladding inclination angle $\beta$ in a diagrammatic vertical section through a grinding and classifying chamber of an air-swept mill.
Figure 11B:
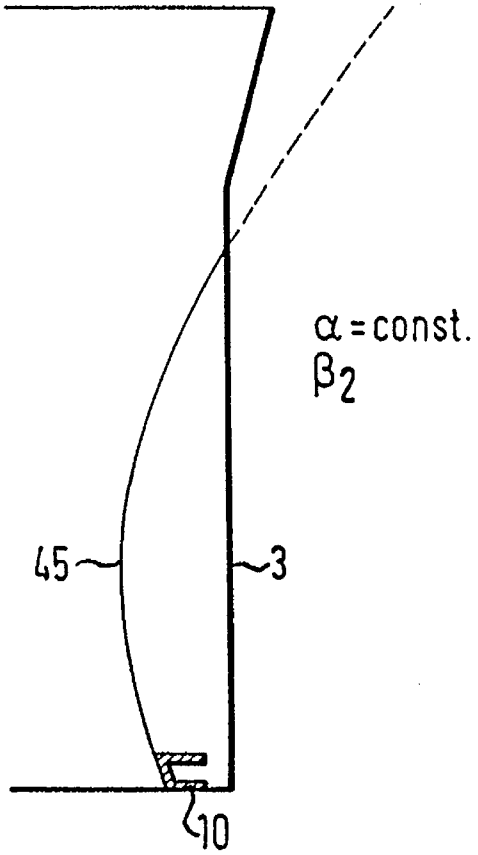
Figure 11A:
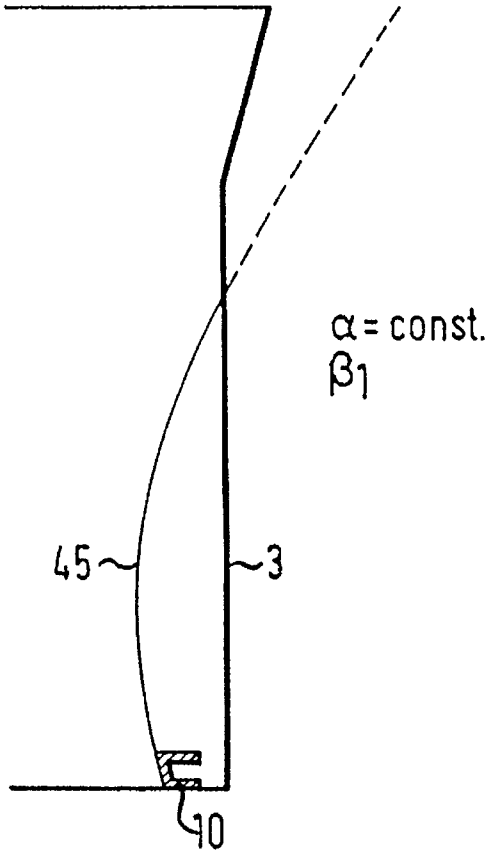
Figure 13:
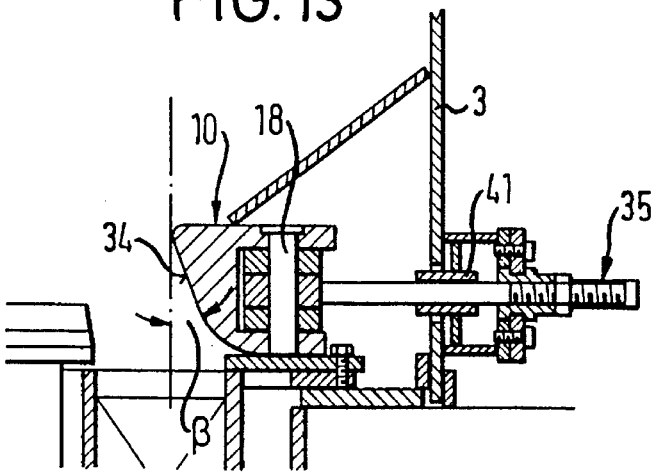
FIG. 13 A vertical section along line A—A of FIG. 12.
Figure 14:
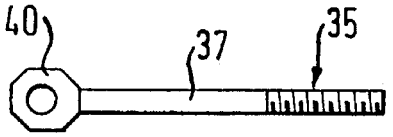
FIG. 14 A plan view of an adjusting element.

FIG. 11 shows a flow envelope from which it is possible to gather the influence of the setting angle $\alpha$ of the blades of the blade ring 12 (cf. FIG. 1) and the inclination angle $\alpha$ of the guide surface 34 against a vertical (cf. FIG. 13). The flow envelopes 45 show the spatial structure of the arrangement and the extension of the flow envelope curve in the vertical and horizontal or radial direction and in a one-sided, axial vertical section through a hyperboloid flow envelope curve represent the outer boundary thereof, the spacing from a casing wall 3 and a fictional intersection with the casing wall 3 as the impact point of a hyperboloid torus from marginal zone oversize material or outer oversize material.

As a function of the setting angle $\alpha$ and the inclination angle $\beta$ the curves of the flow envelope 45 have a varied curvature. The curves of the flow envelope 45 according to FIG. 11 make it clear the influence of an adjustment of the reinforcing cladding segments in conjunction with a helical fluid feed flow from clearly set blades of a blade ring 12 on the shape of the hyperboloid torus and therefore on the flow resistance, the throughput and in particular on a discharge of marginal zone oversize material in a "dead area" between the casing wall 3 and the curve of the flow envelope 45. In this connection importance is attached to the "fictional" intersection of the curve of the flow envelope 45 and the casing wall, because this intersection represents a type of upper impact point for the oversize material on the casing and therefore influences the size of the "dead area" between the casing wall 3 and the curve of the flow envelope 45, in which optionally collect outwardly removable marginal zone oversize material.

In a method, which with respect to an optimized energy balance at least partly removes marginal zone oversize material from the grinding chamber below the classifying chamber, it is possible to use a clearly defined position of this impact point for an optimum positioning of a device for collecting and removing a proportion of almost vented marginal zone oversize material, e.g. a collecting pocket.

Figure 12:
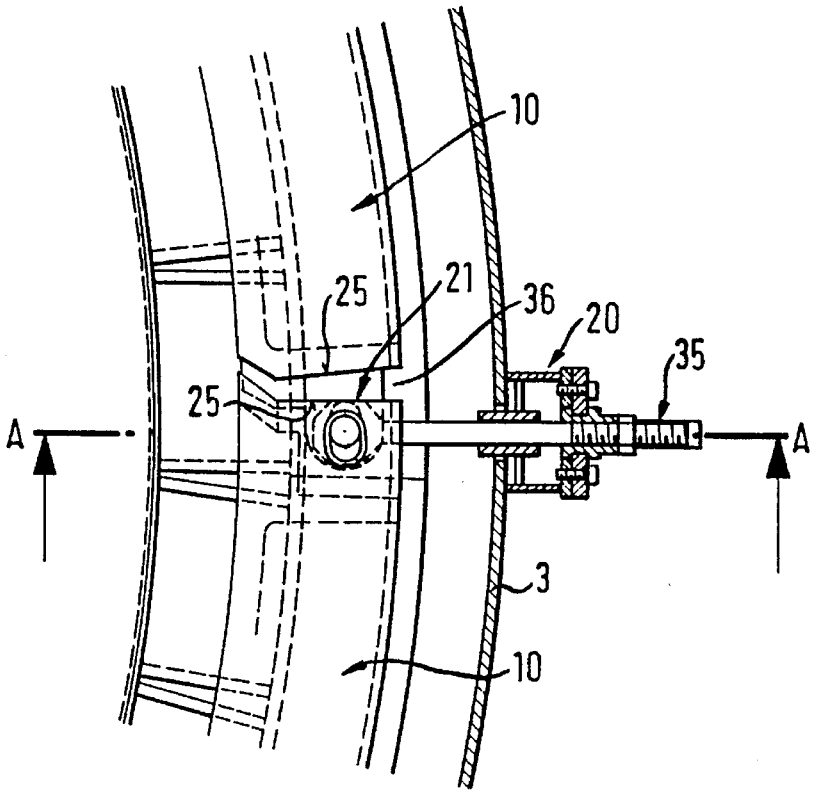
FIG. 12 A plan view of a connecting area between two reinforcing cladding segments with engaging adjusting device.

FIG. 12 diagrammatically shows an adjusting device 20, which acts on a connecting area 21 with an adjusting element 35. In the starting position the end faces 25 of the two detachably connected reinforcing cladding segments 10 and an almost conical spacing gap 36 can be seen. The adjusting element 35 (FIG. 14) has a bolt shank 37 and a guide head 40, which is provided with a bore for receiving a connecting bolt 18 (FIG. 13). The guide head 40 is inserted and fixed in the connecting area 21. The bolt shank 37, which is held in the vicinity of the casing wall 3 by a sliding block-like guide 41, can be operated outside the casing wall. The adjustment can take place manually, mechanically, hydraulically or electromotively.

I claim:

1. A method for supplying material to a rotary, horizontal grinding surface of a grinding classifying chamber and for crushing to grinding material particles, comprising:

supplying grinding material particles to a classifying process with the aid of a fluid feed flow, discharging fine material particles; and returning at least part of oversize material occurring as coarse material particles to the grinding surface, supplying the fluid feed flow in an annular space with a blade ring between the grinding surface and a casing wall having adjustable reinforcing cladding segments, wherein the process further comprises:

exposing the grinding material particles thrown off over an edge of the grinding surface to a helical pattern of the feed flow, forming a helical fluid feed flow envelope from the thrown off grinding material particles in a helical upward movement in which the grinding material particles are moved in a helical pattern and the spatial arrangement of the flow envelope is adjusted by regulating the fluid feed flow.

2. Method according to claim 1, wherein the helical fluid feed flow is brought about with a speed of <30 m/s by means of a gas guiding device producing a vortex and a virtually fines-free, outer oversize material flow forms the flow envelope.

3. Method according to claim 2, wherein a hyperboloid torus of outer oversize material forms the flow envelope and a curve of the flow envelope or the hyperboloid torus is modified with the aid of an adjustable guide blade ring and/or adjustable reinforcing cladding segments.

4. Method according to claim 3, wherein the outer oversize material flow is at least partly taken from the grinding chamber and wherein removal thereof takes place as a function of an impact point of the hyperboloid torus on the casing wall, the impact point being determined with the aid of the curve of the flow envelope.

5. Method according to claim 3, wherein the curve of the flow envelope or the hyperboloid torus is set with the aid of reinforcing cladding segments which are at least one of inclination-adjustable reinforcing cladding segments and horizontally displaceable reinforcing cladding segments.

6. Method according to claim 5, wherein the curve of the flow envelope or the hyperboloid torus is modified with the aid of partially adjustable reinforcing cladding segments.

7. An air-swept mill for crushing material, comprising an annular space with a blade ring for a fluid feed flow between a rotary grinding pan and a casing wall with adjustable reinforcing cladding segments, wherein adjacent said adjustable reinforcing cladding segments are connected by connecting elements which are located on end faces of the reinforcing cladding segments, wherein an externally operable adjusting device acts on at lest one of said connecting elements, and wherein the reinforcing cladding segments are arranged so as to be at least radially displaceable.

8. Apparatus according to claim 7, wherein an adjusting device is provided for operating on several connecting areas.

9. Apparatus according to claim 7, wherein the reinforcing cladding segments are constructed as circular ring sectors and the connecting elements areas are joints.

10. Apparatus according to claim 9, wherein a spacing gap is formed between the reinforcing cladding segments for ensuring a horizontal displacement and inclination adjustment of two adjacent reinforcing cladding segments for a virtually sealed reinforcing cladding ring.

11. Apparatus according to claim 10, wherein at least one frontal area of the reinforcing cladding segments is provided with bevels.

12. Apparatus according to claim 9, wherein the joints are selected from axial joints and fork joints.

13. Apparatus according to claim 10, wherein at least one frontal area of the reinforcing cladding segments is provided with recesses.

14. Apparatus according to claim 7, wherein each reinforcing cladding segment is constructed with a lower, almost horizontal sliding surface, an upper cover surface substantially parallel thereto and a bevelled guide surface inclined towards an axis of the grinding chamber.

15. Apparatus according to claim 14, wherein the reinforcing cladding segments are constructed with an inclination angle $\beta$ continuously varying in the circumferential direction.

16. Apparatus according to claim 15, wherein the adjustable reinforcing cladding segments are mounted in inclination-adjustable manner in a horizontal pivot pin.

17. Apparatus according to claim 16, wherein stationary reinforcing cladding segments alternate with inclination-adjustable or pivotable reinforcing cladding segments.

18. Apparatus according to claim 16, wherein the horizontal pivot pins of the inclination-adjustable reinforcing cladding segments are located in receptacles close to the casing wall.

19. Apparatus according to claim 7, wherein the adjusting device comprises an adjusting element, which is provided with a bolt shank led out of a mill casing and with a guide head for arranging in a connecting area.

20. Apparatus according to claim 19, wherein the adjusting device is manually, hydraulically or electromotively operable.

21. Apparatus according to claim 7, wherein the number of radially displaceable reinforcing cladding segments is determined by the number of grinding rollers.

22. An air-swept mill for crushing material, comprising an annular space with a blade ring for a fluid feed flow between a rotary grinding pan and a casing wall with adjustable reinforcing cladding segments, wherein adjacent said adjustable reinforcing cladding segments are connected by connecting elements which are located on end faces of the reinforcing cladding segments, wherein an externally operable adjusting device acts on at least one of said connecting elements, wherein the reinforcing cladding segments are arranged so as to be at least radially displaceable, and wherein the reinforcing cladding segments are constructed as circular ring sectors and the connecting elements are joints, said joints being selected from axial joints and fork joints.

* * * * *